United States Patent [19]

Keith

[11] 4,075,811

[45] Feb. 28, 1978

[54] BUILDING ROOF PANEL

[75] Inventor: Donald B. Keith, Owasso, Okla.

[73] Assignee: Nordam, Tulsa, Okla.

[21] Appl. No.: 740,865

[22] Filed: Nov. 11, 1976

[51] Int. Cl.[2] ..... F04D 3/36

[52] U.S. Cl. ..... 52/395; 52/465; 52/584; 52/471

[58] Field of Search ..... 52/465, 469, 395, 493, 52/460, 461, 49, 588, 463, 459, 470, 471, 615, 619, 620

[56] References Cited

U.S. PATENT DOCUMENTS

| | | | |
|---|---|---|---|
| 230,161 | 7/1880 | Walker | 52/461 |
| 1,343,786 | 6/1920 | Murphy | 52/469 |
| 1,654,573 | 1/1928 | Bonsall | 52/469 |
| 3,392,497 | 7/1968 | Cushman | 52/615 |
| 3,670,466 | 6/1972 | Lynch | 52/615 |
| 3,793,789 | 2/1974 | Greenamyer | 52/584 |
| 3,815,307 | 6/1974 | Tantlinger | 52/588 |

*Primary Examiner*—John E. Murtagh

*Attorney, Agent, or Firm*—Head, Johnson & Chafin

[57] ABSTRACT

A roof panel that is lightweight and structurally strong, and that can be assembled with other panels to form large area surfaces, comprises a rectangular panel made with an extruded U-shaped channel frame member, that is mitered at the corners. The frame is enclosed by two sheet members that are attached by adhesive bond supplemented by screws or other type fasteners to the outer surface arms of the frame. The base portion of the U-shaped channel member has a flange extension on one side whereby the two edges of two adjacent panels can be bolted together. A resilient sealing gasket is placed between the two flange extensions, of the U member so that as the bolts tighten the two members together, the joint between is sealed by the gasket. After the two panels are joined in this manner, a specially shaped inverted U shaped ridge cover channel is placed over the sealed joint, and is latched into notches, which hold the cover in place. The boxed-in section comprising the frame and sheet members is filled with an appropriate composition of foamed plastic.

14 Claims, 7 Drawing Figures

BUILDING ROOF PANEL

BACKGROUND OF THE INVENTION

1. Field of the Invention

This invention lies in the field of portable buildings. More particularly, it concerns the design and construction of a rigid rectangular roof panel that can be joined with other panels in a sealed, weather-tight manner to provide large horizontal roof areas for buildings.

2. Description of the Prior Art

In the prior art, portable building construction has normally used separate vertical panels for internal and external walls of a building. The problem in roofing construction for such portable structures is sealing the joints between horizontal panels. In general, the sealing has taken the form of flexible covering materials that are cemented over the joints in the roof panels, which provide little flexibility in assembly and disassembly of the panels.

SUMMARY OF THE INVENTION

It is a primary object of this invention to provide a type of rigid rectangular roofing panel that can be assembled in the field with other similar roof panels, by simply bolting together, so that the joint is sealed and protected from the weather.

It is a still further object of this invention to provide a type of rectangular roof panel that can be assembled and disassembled by simply applying a plurality of bolts, which tie together adjacent edges of the panels to form a structurally rigid panel of increased area, that is sealed and protected from the weather.

These and other objects are realized and the limitations of the prior art are overcome in this invention by providing a roof panel which is constructed of a frame made of a metal extrusion. The cross-section of the frame is in the form of a U-shaped channel, in which the base of the U is extended on one side to form a flange. The flange is of substantial thickness so that it can be bolted against the flange of another panel to form a strong rigid structural combination. The flange is machined so that when the two flanges of adjacent panels are brought together a specially shaped gasket made of compliant material can be inserted between the flanges, so that when they are bolted together the joint is sealed against the entry of moisture.

Three lengths of this special channel are mitered and fastened together to form a rectangular frame, the fourth edge (not shown) is at the building eve and is formed of a sheet metal member. The U shaped member is turned on its side so that the flange extends upwardly, on what is to be the external edges of the panel. The top and bottom of the panel are constructed of thin sheet metal which are attached to the outer surfaces of the arms of the U shaped channels, by means of adhesive bond supplemented by screw fasteners, or the like. The internal volume of the panel is then filled, through appropriate openings, with a foam plastic which tightly fills the interior volume, supports the thin sheet metal coverings to provide a rigid structure, and also provides thermal insulation over the internal area of the panel. Special coverings are provided in the form of inverted U-shaped ridge cover members which can be laid over the edges of the flanges and locked in position. By these cover members the gaskets and bolts are protected from exposure to the elements. At the two way and four way junctions, between panels, special ridge cover plates provide additional weather protection over the joints between the ridge cover members.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
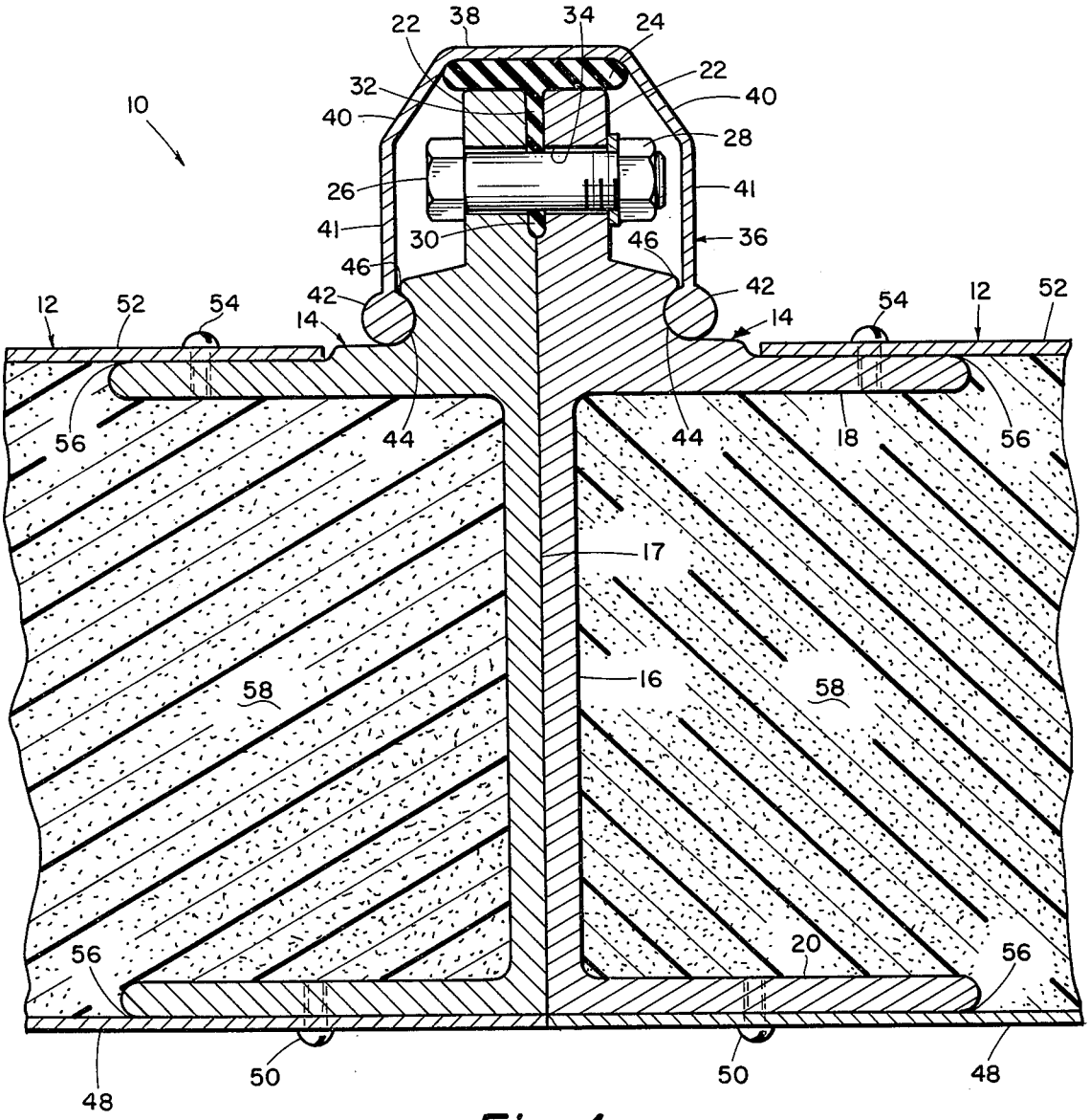
FIG. 1 shows a cross-section between the two matching edges of two panels constructed in accordance with this invention.

Referring now to the drawings and in particular to FIG. 1, there is shown in cross-section the basic construction of the separate panels, and the means for coupling two panels, edge to edge, and means for protecting the exposed joint between the two panels with weather protection.

Numeral 10 indicates generally the type of construction involved. Numeral 12 indicates generally each of the panels which are to be joined.

The panels 12 are constructed using a rectangular frame made of metal extrusions, generally of aluminum, which are in the form of U shaped channels. The base 16 and the arms 18 and 20 of the channels are of sufficient thickness to provide the required strength to the frame.

There is a flange extension 22 to the base 16 on one side of the channel namely on the outside of the arm 18 which is the top side of the frame and panel. The flange 22 is for the purpose of bolting together two frames which are placed in contact along the surfaces 17, which form the base surfaces of the U shaped extrusions. The frames are cut and joined together, with appropriate gussets (not shown). They are further reinforced by rectangular sheets 48, on the bottom, and 52 on the top, which are held to the arms 20 and 18 respectively by means of adhesive bond with screws or other types of fasteners 50, 54, to prevent the adhesive bond from peeling. The two metal sheets 52 and 48 provide a structurally rigid panel.

The internal volume 58 of the panel is filled with a suitable foam plastic which hardens into a rigid lightweight, thermally insulating, support for the frame and the thin sheet metal coverings. Thus, each of the panels is a lightweight assembly, having a strong frame, reinforced by means of two parallel sheets, with the internal volume filled with a rigid foam. These panels are easily handled, lifted into position, and can be rapidly transported from one location to another.

When two panels are to be joined edge to edge, the flange extensions 22 are placed together so that the plane contact surfaces 17 fit closely as shown in FIG. 1. The contact surfaces at the outer ends of the flanges are machined to provide a gap 30, into which is fitted a gasket, which when compressed, takes the form of a T, with the leg portion placed within the gap 30. Gasket may be in the form of a standard bulb seal cross-sectional design (also referred to as a "tadpole" seal), the tubular or bulb portion of the gasket being collapsed into the cap of the "T" as illustrated. In addition, a special "T" shape gasket may also be employed. As the two flanges are drawn together by means of bolts 26 and nuts 28, for example, the leg portion 32 of the gasket 24 will be squeezed tightly, and will provide a seal in the gap between the two surfaces 17. The gasket top portion 24 which lies across the top of the flanges and acts as a shield against moisture entering into the space between the flanges.

There are a plurality of openings 34 through the flanges 22 so that a plurality of bolts and nuts can be used to tightly clamp the flanges together.

In placing these panels on a structure, the upper surface of the panel is the one that has the flanges 22. Thus, by a single row of bolts, which are exposed and can easily be inserted and tightened, the panels can be assembled and disassembled.

After the panels have been bolted together a special ridge cover member, or ridge cover channel, 36 is placed over the joint. The ridge cover is an inverted U shaped channel, which has a flat portion 38, which is above the part 24 on the gasket, two sloping portions 40, and two legs 41 which terminate in cylindrical edges 42. These edges are shaped to fit into cylindrical grooves 44 which are formed in the surface of the extrusion. The ridge covers are made by extrusions of a suitable metal, such as aluminum, and form a rigid member with considerable spring in the two legs of the channel. Thus, they can be pressed over the projections 46 on the flanges, and locked into the grooves 44, providing a mechanically tight attachment, and adequate weather protection for the joints, including the gaskets and the bolts and nuts.

Figure 2:
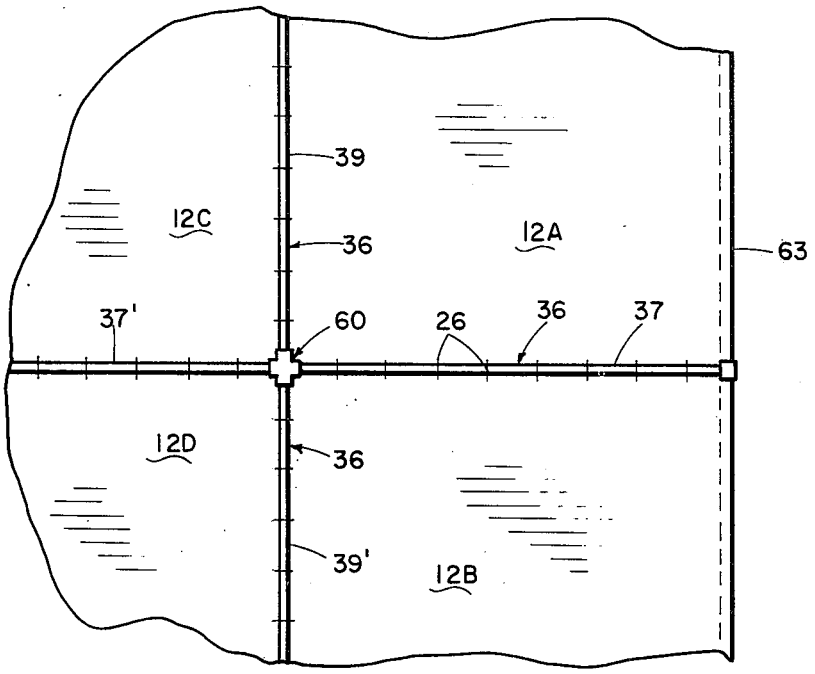
FIGS. 2 and 2A illustrate a plan view of a roof including the junction between four, between two, and adjacent panels.

Referring to FIG. 2, there is shown a plan view of a portion of a large roof having an edge 63 and an internal junction 60 where there are four corners of panels 12A, 12B, 12C, 12D which come together at a point.

There is a junction 37 between panels 12A and 12B which is held together by means of bolts 26, for example. There are also a second pair of panels 12C and 12D which form a junction 37' which are joined in accordance with the details of FIG. 1.

Panels 12C and 12D are then joined along an interface 39' to panels 12A and 12B in a corresponding manner to that shown in FIG. 1.

Figure 2A:
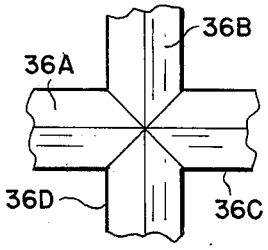

Each of the panels have the frame mitered in the corners to form the panels. Also the four 90° corners of the frame of the panels then fit together with each of the others to form a strong bolted structure. However, when the ridge cover 36 is applied over the flanges, it will be seen that the ridge cover itself, as shown in FIG. 2A, must be mitered in order to closely fit together at that point.

It will be clear that the mitered ends of the ridge covers 36 leave openings between the mitered portions, through which rain and dust and dirt can enter into the space under the ridge cover.

Figure 5:
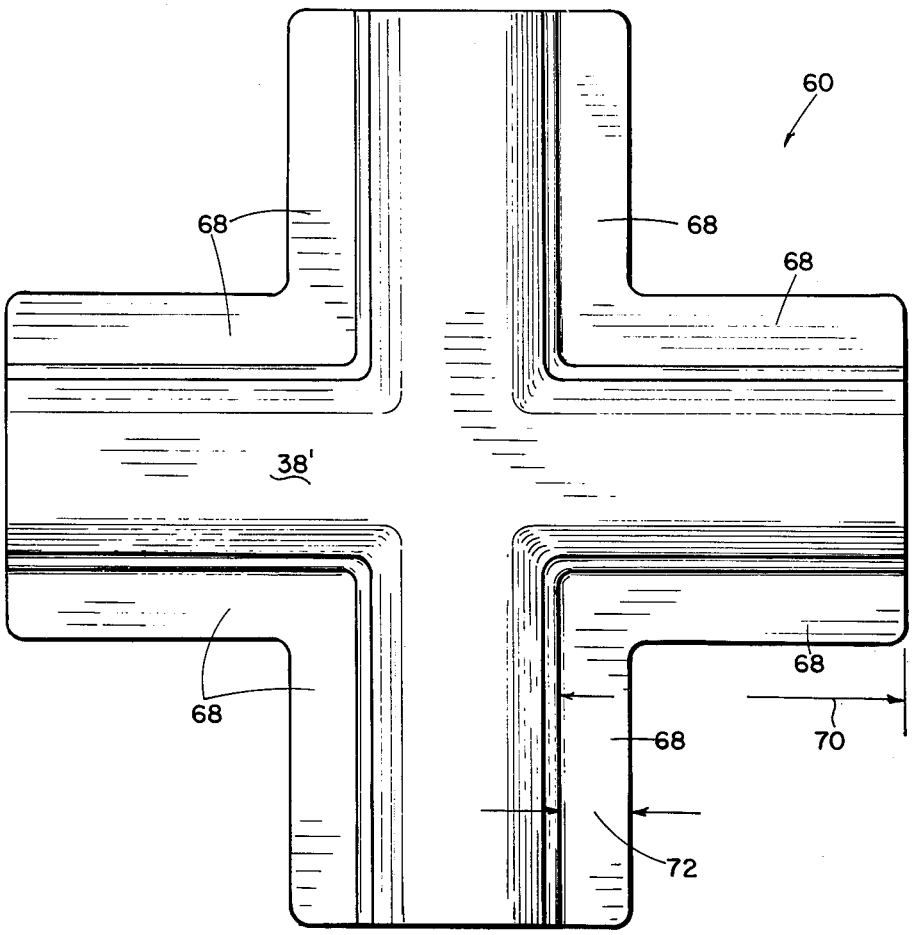
FIGS. 5 and 6 show plan and elevation views of a ridge cover plate at a four way joint between four panels.
Figure 6:
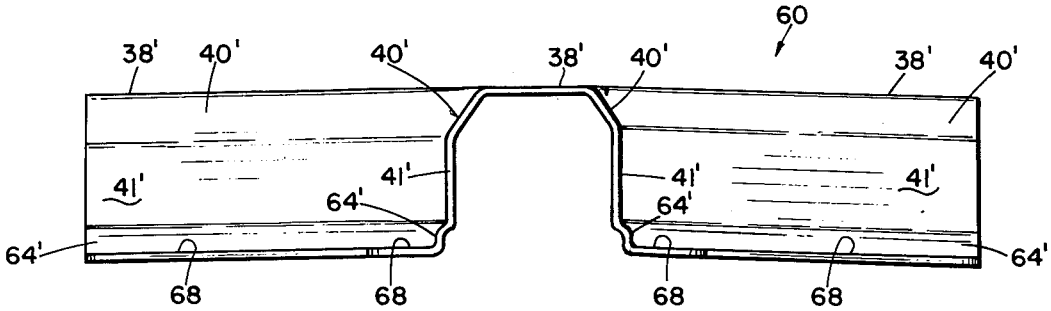

This junction is then further protected by means of a ridge junction plate, such is shown in FIGS. 5 and 6. This has the same general cross-sectional shape as the ridge cover 36 and comprises a flat portion 38', two sloping portions 40' and two leg portions 41'. Also there is a cylindrical portion 64' which connects to a horizontal flange 68. The dimensions of the various parts 38', 40', 41', etc. are such as to fit over the corresponding parts 38, 40, 41, and 42 of the ridge cover channels. By making sufficient length 70 to the arms of the junction plate, and sufficient width 72 to the flanges, adequate protection against the entry of water, dirt, and dust, and the weather generally, is prevented by covering the mitered joints between the ridge channels 36A, 36B, 36C and 36D of FIG. 2A.

Figure 3:
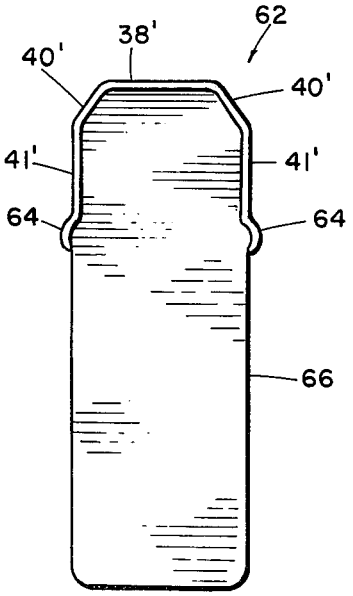
FIGS. 3 and 4 show two views of a cover plate which provides protection over the exposed end of a ridge cover member over the joint between two panels.
Figure 4:
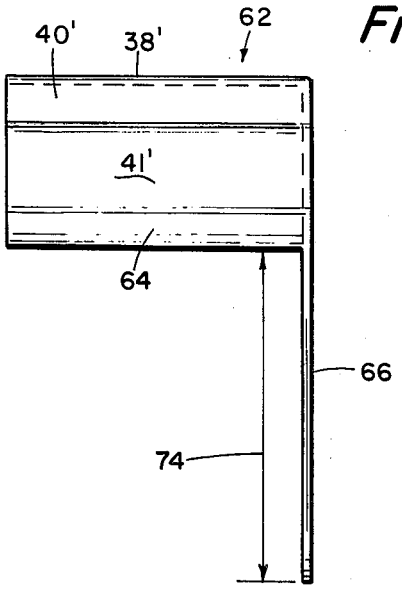

Similarly, there is an open end at point 62 to the ridge channel 37 that covers the joint. This open end of the ridge channel is protected by a fixture shown in FIGS. 3 and 4. This comprises an inverted U portion 38', 40', 41' and 64, identical to those portions of the junction plates 60. The end of this channel 62 is closed by a vertical plate 66, which seals the end of the ridge cover channel and extends downward a distance 74 and seals the exposed joints at the surfaces 17 of the panels.

What has been described is a lightweight, rigid, transportable roof panel, that has mechanical strength and thermal insulation. The panels are designed so that they can be joined on matching edges, by bolting together flanges that comprise extensions of the frame of the roofing panel. The panels can be joined rapidly, by inserting a gasket between the flanges. A plurality of bolts are placed and tightened to lock together corresponding edges of adjacent panels. Ridge cover channels are placed over the exposed edges of the flanges. These ridge channel covers are locked into position by means of a built in detent. Thus the channel covers protect the exposed ends of the flanges from rain, snow and dust.

Where two or more panels come together, there are exposed ends to the ridge cover channels and these are further covered by ridge junction plates 60 for the four way junction and 62 for the two way junction, which provide additional cover for the exposed ends of the ridge cover channels.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A roof panel for a sectional building that can be transported and joined to other roof panels to form an extended area roof, with all joints sealed and protected from the weather, comprising:

(a) a rectangular frame made of sections of an extruded metal form, in the shape of a U channel, turned on its side, comprising:
  (1) a base portion, which forms the outer surface of said frame,
  (2) a bottom leg perpendicular to said base portion which forms the bottom of said frame;
  (3) a top leg perpendicular to said base and spaced from said bottom leg by the width of said base portion, which forms the top of said frame;
  (4) a support flange which forms a vertical extension of said base portion above said top leg; and
  (5) means to attach lengths of said channel to each other to form a rectangular frame;

(b) a first rectangular sheet of metal of substantially the outside shape and area of said frame, and means to attach said sheet to the outside of said bottom legs of said frame;

(c) a second rectangular sheet of metal of the shape and area of the top of said frame inside of said upwardly extending flange, and means to attach said second sheet to the top surfaces of said top legs of said frame;

(d) means to fill the inside volume of said frame and said first and second sheets with a foamed plastic of selected composition; and (e) a resilient gasket of T section, the leg portion being placed between abutting flange surfaces when two panels are placed edge to edge, the top portion covering the tops of the flanges and the joint; and (f) means to press said two flanges together, compressing said gasket and sealing the joint between said two flanges.

2. The panel as in claim 1 in which said support flange is relieved on a part of its outer surface whereby said leg portion of said T gasket is received in the gap between two juxtaposed flanges provided by said relieved parts.

3. The panel as in claim 1 and including a plurality of spaced holes drilled through said support flange, and bolts inserted through said holes to bolt said flanges together.

4. The panel as in claim 1 in which said upwardly extending flange has a reentrant cylindrical trough along its side surface, and including a ridge cover channel having an inverted U shape and a circular bead on its edges;

whereby said channel can be positioned over the flange joint and said beads locked into said reentrant troughs;

whereby said ridges are sealed against rain, dust and dirt.

5. The panel as in claim 1 including four panels meeting at a single corner, with ridge cover channels over each of the four pairs of flanges, and including a four-way ridge cover plate having four arms each in the cross-section of an inverted U shape with horizontal flanges, adapted to be placed, over the four ridge covers;

whereby the joint between the four ridge covers is protected from the weather.

6. The panel as in claim 1 including two panels joined along one edge with a ridge cover channel over the joint and means to seal at least one end of said ridge cover channel, comprising;

an end cap formed in a U shape adapted to fit over the end of said ridge cover, and a plate closing off the end of said cap and extending below said cap.

7. The panel as in claim 6 in which said plate extends to the bottom of said bottom leg.

8. A roof panel for a sectional building that can be transported and joined to other roof panels to form an extended area roof, with all joints sealed and protected from the weather, comprising:

(a) a rectangular frame made of sections of an extruded metal form, in the shape of a U channel, turned on its side, comprising:

(1) a base portion, which forms the outer surface of said frame;

(2) a bottom leg perpendicular to said base portion which forms the bottom of said frame;

(3) a top leg perpendicular to said base and spaced from said bottom leg by the width of said base portion, which forms the top of said frame;

(4) a support flange which forms a vertical extension of said base portion above said top leg, the support flange having a re-entrant trough along its side surface; and (5) means to attach lengths of said channel to each other to form a rectangular frame;

(b) a first rectangular sheet of metal of substantially the outside shape and area of said frame, and means to attach said sheet to the outside of said bottom legs of said frame;

(c) a second rectangular sheet of metal of the shape and area of the top of said frame inside of said upwardly extending flange, and means to attach said second sheet to the top surfaces of said top legs of said frame;

(d) means to fill the inside volume of said frame and said first and second sheets with a foamed plastic of selected composition; and (e) a ridge cover channel having an inverted U shape and beads on its edges whereby said channel can be positioned over the flange joint and said beads locked into said re-entrant troughs when two panels are placed edge to edge whereby the flange joint is protected against rain and dust.

9. The panel as in claim 8 in which said support flange is relieved on a part of its outer surface, whereby when two panels are placed edge to edge, a resilient gasket can be placed in a gap between the two flanges, to seal the joint; and means to press said two flanges together, compressing said gasket and sealing the joint between said two flanges.

10. The panel as in claim 9 and including a plurality of spaced holes drilled through said support flange, and bolts inserted through said holes to bolt said flanges together, said bolts being within and protected by said channel.

11. The panel as in claim 9 in which said resilient gasket has a T section, in which the leg portion is placed between the flange surfaces, and the top portion covers the tops of the flanges and the joint, said gasket being within and protected by said channel.

12. The panel as in claim 8 including four panels meeting at a single corner, with ridge cover channels over each of the four pairs of flanges, and including a four-way ridge cover plate having four arms each in the cross-section of an inverted U shape with horizontal flanges, adapted to be placed, over the four ridge covers;

whereby the joint between the four ridge covers is protected from the weather.

13. The panel as in claim 8 including two panels joined along one edge with a ridge cover channel over the joint and means to seal at least one end of said ridge cover channel, comprising:

an end cap formed in a U shape adapted to fit over the end of said ridge cover, and a plate closing off the end of said cap and extending below said cap.

14. The panel as in claim 13 in which said plate extends to the bottom of said bottom leg.

* * * * *